US007188782B2

(12) United States Patent
Magel

(10) Patent No.: US 7,188,782 B2
(45) Date of Patent: Mar. 13, 2007

(54) FUEL INJECTOR PROVIDED WITH A SERVO LEAKAGE FREE VALVE

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/530,709

(22) PCT Filed: Mar. 4, 2004

(86) PCT No.: PCT/DE2004/000412

§ 371 (c)(1),
(2), (4) Date: Apr. 8, 2005

(87) PCT Pub. No.: WO2004/088121

PCT Pub. Date: Oct. 14, 2004

(65) Prior Publication Data

US 2006/0011735 A1 Jan. 19, 2006

(30) Foreign Application Priority Data

Apr. 2, 2003 (DE) ..... 103 15 016

(51) Int. Cl.
*F02M 41/16* (2006.01)

(52) U.S. Cl. ..... 239/96; 239/88; 239/91; 239/585.1; 239/533.2

(58) Field of Classification Search ..... 239/88–91, 239/533.2, 533.3, 533.4, 585.1, 585.5
See application file for complete search history.

(56) References Cited

U.S. PATENT DOCUMENTS 5,819,710 A * 10/1998 Huber ..... 123/498
6,427,664 B1 8/2002 Boecking
6,453,875 B1 * 9/2002 Mahr et al. ..... 123/446
6,752,325 B2 * 6/2004 Kropp et al. ..... 239/88
6,776,138 B2 * 8/2004 Mahr et al. ..... 123/446
6,789,743 B2 * 9/2004 Baranowski et al. ..... 239/124
6,810,856 B2 * 11/2004 Magel ..... 123/446
6,811,103 B2 * 11/2004 Gurich et al. ..... 239/533.2
6,871,636 B2 * 3/2005 Boecking ..... 123/467
6,889,659 B2 * 5/2005 Magel ..... 123/446
6,892,703 B2 * 5/2005 Magel ..... 123/446

(Continued)

FOREIGN PATENT DOCUMENTS

DE 199 49 848 A1 4/2001

(Continued)

*Primary Examiner*—Kevin Shaver
*Assistant Examiner*—Trevor McGraw
(74) *Attorney, Agent, or Firm*—Ronald E. Greigg

(57) ABSTRACT

A fuel injector having a pressure booster whose booster piston separates a working chamber, which is continuously acted on with fuel by means of a pressure source, from a differential pressure chamber that can be pressure-relieved; a pressure change in the differential pressure chamber occurs via an actuation of a servo-valve whose control chamber can be pressure-relieved by an on/off valve that also opens or closes a hydraulic connection of the differential pressure chamber to a first return on the low-pressure side. In the deactivated state of the pressure booster, a first sealing seat seals a return on the low-pressure side off from a high-pressure region of the servo-valve, which region is comprised of the control chamber, a first hydraulic chamber, and a second hydraulic chamber.

11 Claims, 2 Drawing Sheets

U.S. PATENT DOCUMENTS

| | | | | |
|---|---|---|---|---|
| 6,915,785 | B2 * | 7/2005 | Eisenmenger et al. | 123/446 |
| 2004/0025843 | A1 | 2/2004 | Magel | |
| 2004/0025845 | A1 | 2/2004 | Magel | |
| 2004/0231645 | A1 * | 11/2004 | Magel | 123/446 |

FOREIGN PATENT DOCUMENTS

| | | | |
|---|---|---|---|
| DE | 101 23 914 | A1 | 11/2002 |
| DE | 102 18 904 | A1 | 12/2002 |
| DE | 10218904 | A1 * | 12/2002 |
| WO | WO 03/018995 | A1 | 3/2003 |
| WO | WO 2004/003376 | A1 | 1/2004 |
| WO | WO 2004/036027 | A1 | 4/2004 |

* cited by examiner

FUEL INJECTOR PROVIDED WITH A SERVO LEAKAGE FREE VALVE

CROSS-REFERENCE TO RELATED APPLICATIONS

This application is a 35 USC 371 application of PCT/DE 2004/000412 filed on Mar. 4, 2004.

BACKGROUND OF THE INVENTION

1. Field of the Invention

This invention relates to an improved fuel injector system for use with internal combustion engines.

2. Description of the Prior Art

Stroke-controlled injection systems with a high-pressure accumulator are known and used to deliver fuel in direct-injecting internal combustion engines. The advantage of these injection systems lies in the fact that the injection pressure can be adapted to wide ranges of load and engine speed. A high injection pressure is required in order to reduce emissions and to achieve a high specific output. Since the achievable pressure level in high-pressure fuel pumps is limited for strength reasons, pressure boosters are used in the fuel injectors in order to further increase pressure in fuel injection systems.

Stroke-controlled injection systems with a high-pressure accumulator are used to deliver fuel in direct-injecting internal combustion engines. The advantage of these injection systems lies in the fact that the injection pressure can be adapted to wide ranges of load and engine speed. A high injection pressure is required in order to reduce emissions and to achieve a high specific output. Since the achievable pressure level in high-pressure fuel pumps is limited for strength reasons, pressure boosters are used in the fuel injectors in order to further increase pressure in fuel injection systems.

DE 101 23 913 relates to a fuel injection apparatus for internal combustion engines, having a fuel injector that can be supplied from a high-pressure fuel source. A pressure boosting device that has a movable pressure booster piston is connected between the fuel injector and the high-pressure fuel source. The pressure booster piston divides a chamber that can be connected to the high-pressure fuel source from a high-pressure chamber connected to the fuel injector. The fuel pressure in the high-pressure chamber can be varied by filling a return chamber of the pressure boosting device with fuel or by emptying fuel from this chamber. The fuel injector has a movable closing piston for opening and closing injection openings. The closing piston protrudes into a closing pressure chamber so that fuel pressure can be exerted on the closing piston in order to produce a force that acts on the closing piston in the closing direction. The closing pressure chamber and the return chamber are constituted by a combined closing pressure/return chamber, all of the partial regions of the closing pressure/return chamber being permanently connected to one another to permit the exchange of fuel. A pressure chamber is provided for supplying fuel to the injection openings and for exerting a force on the closing piston in the opening direction. A high-pressure chamber is connected to the high-pressure fuel source so that aside from pressure fluctuations, at least the fuel pressure in the high-pressure fuel source can continuously prevail in the high-pressure chamber. The pressure chamber and the high pressure chamber are constituted by a combined injection chamber, all of the partial regions of the injection chamber being permanently connected to one another to permit the exchange of fuel.

DE 102 294 18.6 relates to a fuel injection apparatus for injecting fuel into the combustion chamber of an internal combustion engine. The fuel injection apparatus includes a high-pressure source, a pressure booster, and a metering valve. The pressure booster has a working chamber and a control chamber that are separated from each other by a piston; a pressure change in the control chamber of the pressure booster causes a pressure change in a compression chamber. Via a fuel inlet, the compression chamber acts on a nozzle chamber encompassing an injection valve member. A nozzle control chamber that acts on the injection valve member can be filled on the high-pressure side from the compression region via a line containing an inlet throttle restriction and can also be connected on the outlet side to a chamber of the pressure booster via a line containing an outlet throttle restriction.

The metering valve according to the above-described design is embodied in the form of a 3/2-way valve that controls a large return flow quantity occurring in this pressure booster-equipped design. Although embodying the metering valve in the form of a 3/2-way servo-valve does achieve a simplified, inexpensive manufacture, it is disadvantageous that a leakage gap forms between the control chamber of the servo-piston of the servo-valve and a return line when the fuel injector is idle. The actuation fluid flowing out through the leakage gap decreases the efficiency of the system and requires that the sealing gap be provided with a long guidance length. A long guidance length of the sealing gap in turn requires a long structural length of the valve body of the servo-valve, which is undesirable in terms of available installation space since the aim is to produce a fuel injector that has an integrated pressure booster and is as compact as possible.

SUMMARY OF THE INVENTION

The proposed design of the servo-valve according to the present invention for a fuel injector equipped with a pressure booster for direct-injection internal combustion engines does not have any leakage at the piston of the servo-valve in the idle state. This significantly reduces the leakage quantity, making it possible to significantly improve the efficiency of the fuel injector. The selected design of a 3/2-way servo-valve makes it possible to significantly reduce the guide lengths required in the servo-valve, thus decreasing the structural length of the servo-valve and the amount of space it requires. This makes it possible to produce a very compact servo-valve for controlling a fuel injector equipped with a pressure booster.

The servo-valve embodied in the form of a 3/2-way valve can be embodied in the form of a double seat valve. To that end, the valve is embodied with a one-piece servo-valve piston and with a multi-part valve body. Providing a sealing seat on the servo-valve makes it possible to compensate for an axial offset of a multi-part servo-valve housing. The proposed design of the 3/2-way servo-valve in the form of a double seat valve can avoid the wear and tolerance problems that occur when using slider seals that have small overlap lengths. The easy access to the valve seats facilitates manufacture.

BRIEF DESCRIPTION OF THE DRAWINGS

The present invention will be described in detail below, in conjunction with the drawings, in which.

DESCRIPTION OF THE PREFERRED EMBODIMENTS

Figure 1:
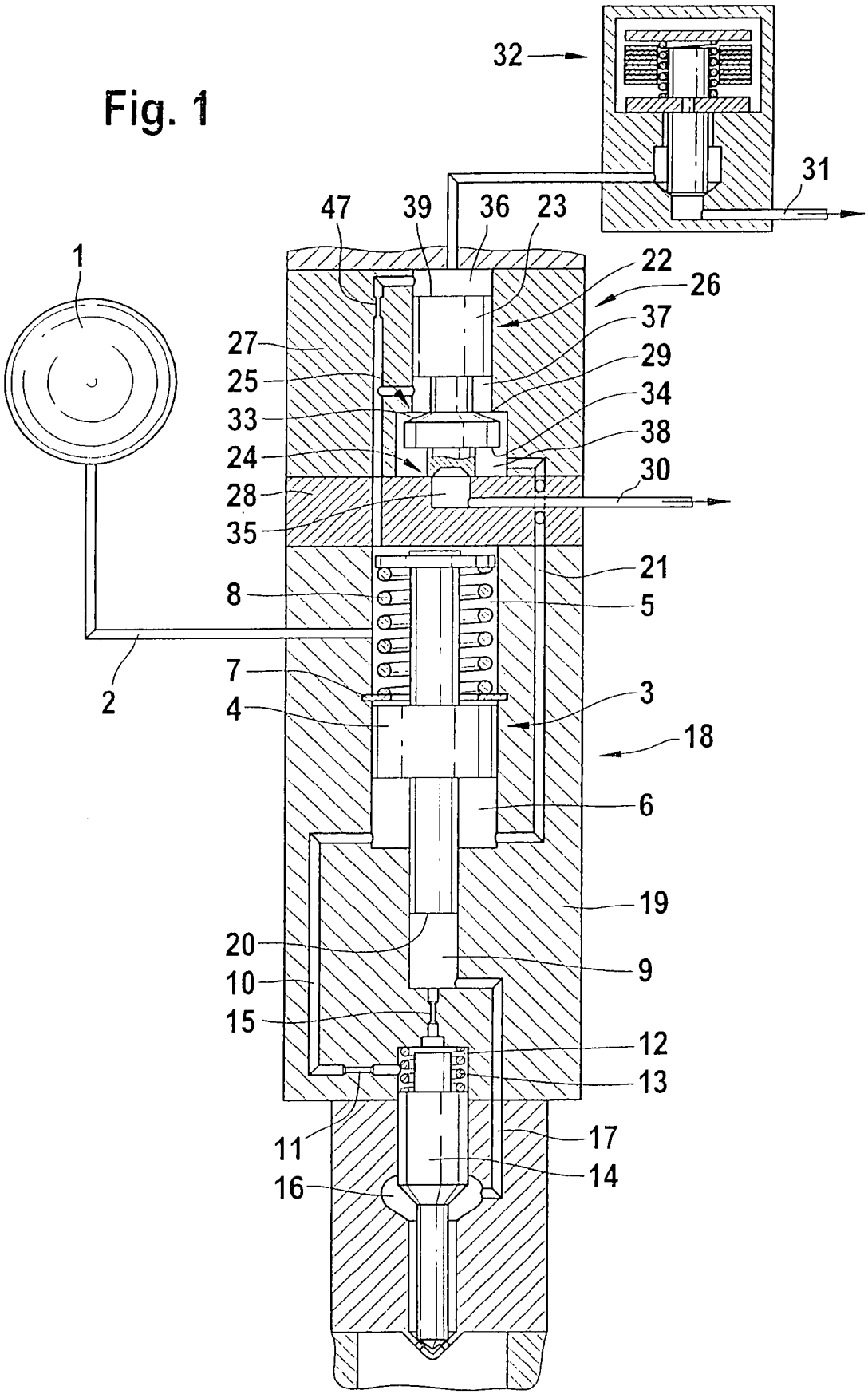
FIG. 1 shows an embodiment of a servo-valve with a leakproof servo-valve piston, which is associated with a fuel injector equipped with a pressure booster

A pressure source 1, which can be embodied in the form of a high-pressure accumulator of a fuel injection system, acts on a high-pressure line 2 with highly pressurized fuel. The high-pressure line 2 feeds into a working chamber 5 of a pressure booster 3. The working chamber 5 is continuously acted on with the highly pressurized fuel of the pressure source 1. The working chamber 5 of the pressure booster 3 is separated from a differential pressure chamber 6 (return chamber) of the pressure booster 3 by a booster piston 4. The booster piston 4 of the pressure booster 3 is acted on by a return spring 8 that rests against a backup washer 7, which in turn is accommodated in an injector body 19 of the fuel injector 18. The booster piston 4 of the pressure booster 3 acts on a compression chamber 9 of the pressure booster 3. The end of the booster piston 4 oriented toward the compression chamber 9 has an end surface 20 which, when the pressure booster 3 is activated, travels into the compression chamber 9 of the pressure booster 3 and compresses the fuel contained therein.

The differential pressure chamber 6 (return chamber) of the pressure booster 3 communicates via an overflow line 10 with a control chamber 12 that acts on an injection valve 14. The overflow line 10 between the differential pressure chamber 6 (return chamber) and the control chamber 12 for the injection valve member 14 contains a first throttle restriction 11 that is disposed upstream of the control chamber 12 in the flow direction of the fuel. In addition, the control chamber 12 for the injection valve member 14 communicates with the compression chamber 9 of the pressure booster 3 via a line containing a second throttle restriction 15. The control chamber 12 for the injection valve member 14 contains a spring 13 that acts on the upper end surface of the needle-shaped injection valve member 14. The injection valve member 14 has a pressure step that is encompassed by a nozzle chamber 16 contained in a nozzle body. From the control chamber 16, the fuel volume traveling from the compression chamber 9 into the nozzle chamber 16 via a nozzle chamber inlet 17 flows along an annular gap at the combustion chamber end of the injection valve member 14 to injection openings and is injected into the combustion chamber of the engine when the needle-shaped injection valve member 14 unblocks the injection openings.

In addition to the overflow line 10, a discharge line 21 also branches off from the differential pressure chamber 6 (return chamber) of the pressure booster. This discharge line 21 passes through the injector body 19 of the fuel injector 18 and feeds into a second hydraulic chamber 38 disposed above the pressure booster 3. Above the injector body 19 of the fuel injector 18, a servo-valve 22 is provided, which, in the embodiment variant shown in FIG. 1, has a valve body 26 that includes a first valve body part 27 and a second valve body part 28. The valve body 26 has a servo-valve piston 23 that can open and close a first sealing seat 24 and a second sealing seat 25. In the depiction shown in FIG. 1, the first valve body part 27 is provided with a sealing edge 29 against which a conical surface 33 of the servo-valve piston 23 can be placed in a sealed fashion, thus constituting the second sealing seat 25. At its end oriented away from the control chamber 36 of the servo-valve 22, the servo-valve piston 23 has a first sealing seat 24 embodied here in the form of a flat seat, which can open and close an outlet control chamber 35 that has a first return 30 branching off from it. The servo-valve piston 23 of the servo-valve 22 is actuated by means of an on/off valve 32 that opens and closes a second return 31 leading to a fuel reservoir not shown in FIG. 1. The fuel volume contained in the control chamber 36 of the servo-valve 22 acts on an end surface 39 of the servo-valve piston 23. Both the control chamber 36 and a first hydraulic chamber 37 in the first valve body part 27 are filled by means of a pressure line that branches off from the working chamber 5 of the pressure booster 3. This pressure line is provided with a throttle restriction 47 before it feeds into the control chamber 36 of the servo-valve 22.

In the embodiment variant shown in FIG. 1, the servo-valve piston 23 has a mushroom-shaped section, the top of which is constituted by the conical surface 33. On the side oriented away from the conical surface 33, the mushroom-shaped section is delimited by an annular surface 34.

The fuel volume contained in the control chamber 36 of the servo-valve 22 acts on the end surface 39 of the servo-valve piston 23 of the servo-valve 22 depicted in FIG. 1. When the servo-valve 22 is in the idle state, it is closed, i.e. the second sealing seat 25 is open, while the first sealing seat 24 is closed in relation to the outlet control chamber 35. The servo-valve piston 23 is guided in the first valve body part 27 of the valve body 26 in a high-pressure-tight fashion in relation to the control chamber 36 and the first hydraulic chamber 37. When the servo-valve 22 is in the idle state, the system pressure prevails in this guidance region, i.e. both the control chamber 36 and the first hydraulic chamber 37 contain the same pressure so that no leakage occurs in the direction of the first return 30. The entire region of the servo-valve piston 23 of the servo-valve 22 according to the embodiment variant shown in FIG. 1 is under system pressure in relation to the control chamber 36, the first and second hydraulic chambers 37 and 38, and the second sealing seat 25. Because the first sealing seat 24 above the outlet control chamber 35 is closed, this system is free of leakage in the direction of the first return 30.

Figure 2:
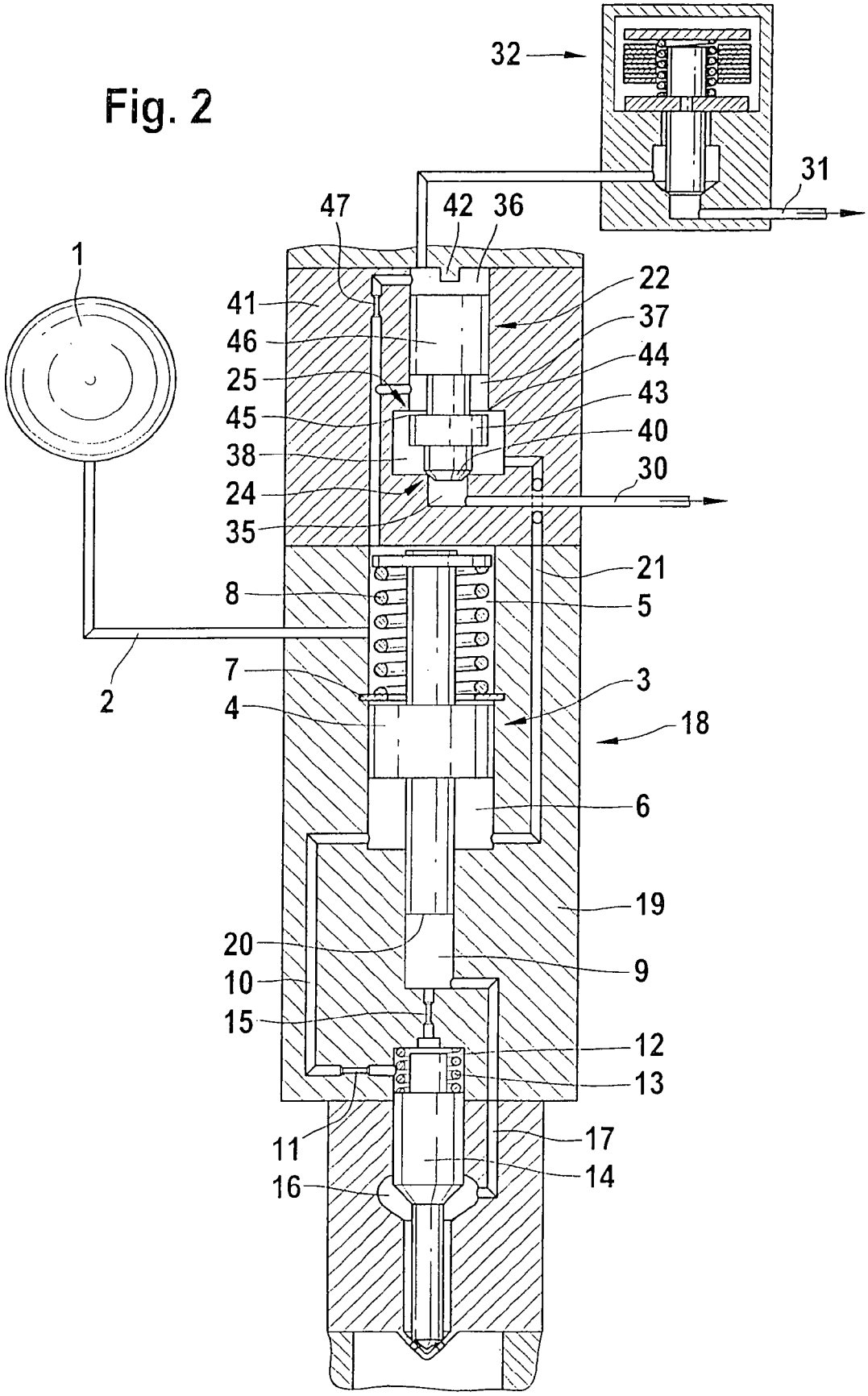
FIG. 2 shows another structural embodiment of a servo-valve with a sealing seat embodied in the form of a conical seat and a one-piece valve housing.

FIG. 2 shows an embodiment variant of the first sealing seat of the servo-valve, which, is embodied in the form of a conical sealing seat, while the other sealing seat of the servo-valve piston is embodied in the form of a slider seal.

FIG. 2 shows an embodiment variant of the first sealing seat of the servo-valve, which, in this embodiment variant, is embodied in the form of a conical sealing seat, while the other sealing seat of the servo-valve piston is embodied in the form of a slider seal.

By contrast with the embodiment variant of the servo-valve shown in FIG. 1, in the region of its first sealing seat 24 above the outlet control chamber 35 to the first return 30, the servo-valve piston 46 according to FIG. 2 is provided with a conical surface 40 that cooperates with a sealing edge provided in a one-piece valve body 41, above the outlet control chamber 35. The servo-valve valve piston 46 of the servo-valve 22 according to FIG. 2 has a slider section 43 whose diameter is identical to that of the piston part of the servo-valve piston 46 that separates the control chamber 36 from the first hydraulic chamber 37. The first hydraulic chamber 37 and the control chamber 36 in the one-piece valve body 41 are supplied with fuel from the working chamber 5 of the pressure booster 3, analogous to the manner shown in FIG. 1. System pressure prevails in the control chamber 36 and in the first hydraulic chamber 37 inside the one-piece valve body 41 of the servo-valve 22. In this embodiment variant as well, no leakage occurs between the above-mentioned hydraulic chambers 36 and 37. Also according to this embodiment variant, system pressure acts on the entire region of the servo-valve piston 46, i.e. the control chamber 36, the first hydraulic chamber 37, and the second hydraulic chamber 38 as well as the second sealing seat 25. If the first sealing seat 24 of the servo-valve 22 is closed, then in this exemplary embodiment of the servo-valve 22 as well, no leakage occurs in the direction of the first return 30 that branches off from the outlet control chamber 35.

The slider section 43 embodied on the servo-valve piston 46 has a slider edge 45 that cooperates with a slider edge 44 on the one-piece valve body 41 of the servo-valve 22.

In lieu of the embodiment variants shown in FIGS. 1 and 2, in which the first sealing seat 24 is embodied in the form of a flat seat (FIG. 1) or in the form of a conical seat (FIG. 2, reference numeral 40) and the second sealing seat 25 is embodied in the form of a conical surface 33 that cooperates with a sealing edge 29 and/or in the form of a slider seal 44, 45, it is also possible to use any combination of flat seats, conical seats, ball seats, or slider edges. It is also possible to use spring elements not explicitly shown in FIGS. 1 and 2 to assist the stroke motion of the servo-valve piston 23 and/or 26.

According to the depiction in FIG. 1, it is advantageous if the servo-valve piston 23 is embodied with a mushroom-shaped section, which has a conical surface 33, and a two-part servo-valve housing 27 is provided that has a first valve body part 27 and a second valve body part 28. This facilitates assembly. If the first sealing seat 24 according to the embodiment variant in FIG. 1 is embodied in the form of a flat seat, it is then possible to compensate for manufacturing tolerances in the axial offset of the two valve body parts 27 and 28 in relation to each other. The first sealing seat 24, which in the embodiment variant according to FIG. 1 is shown in its closed position and is embodied in the form of a flat seat, is held in a sealed fashion against the second valve body part 28 by the powerful hydraulic force prevailing in the control chamber 36 of the servo-valve 22, thus assuring an impervious seal in relation to the first return 30 with currently achievable manufacturing tolerances and for very highly pressurized fuel.

The operation of the fuel injector shown in FIGS. 1 and 2, with a servo-valve 22 that is leakproof in its idle state will be explained in greater detail below in conjunction with the embodiment variant shown in FIG. 1.

The pressure booster 3—in this case integrated into the injector body 19 of the fuel injector 18—includes the working chamber 5 and the differential pressure chamber 6 (return chamber), which are separated from each other by the booster piston 4. The return force on the booster piston is exerted by a return spring 8, which rests against the backup washer 7 provided at its end oriented toward the injector body. The end surface 20 of the booster piston 4 acts on a compression chamber 9 from which the nozzle chamber inlet 17 to the nozzle chamber 16 branches inside this body of the fuel injector 8. In the deactivated idle state, the same system pressure as the one prevailing in the working chamber 5 of the pressure booster 3 also acts on the differential pressure chamber 6 (return chamber) of the pressure booster via the open first sealing seat 25 and the line that branches off from the working chamber 5 of the pressure booster 3 and leads to the first hydraulic chamber 37 and the control chamber 36. In this idle state, the pressure booster 3 is pressure-balanced and no pressure boosting occurs.

In order to activate the pressure booster 3, the differential pressure chamber 6 (return chamber) of the pressure booster 3 is pressure-relieved by triggering the on/off valve 32 to open so that the control chamber 36 of the servo-valve 22 is pressure-relieved into the second return 31. Because of this, the servo-valve piston 23 moves, impelled by the force of pressure prevailing in the second hydraulic chamber 38, which force engages the annular surface 34 and pushes the conical surface 33 upward toward the sealing edge 29 of the first valve body part 27, thus closing the second sealing seat 25 while this upward movement of the servo-valve piston 23 opens the first sealing seat 24. The degree to which the first sealing seat 24 opens is designed to be of such a magnitude that even when the first sealing seat 24 is open, a residual pressure is maintained in the second hydraulic chamber 38. This assures that the servo-valve piston 23 of the servo-valve 22 remains in its open position and the second sealing seat 25 remains continuously closed.

When the first sealing seat 24 is open, the differential pressure chamber 6 (return chamber) of the pressure booster 3 is de-coupled from the high pressure exerted by the high-pressure accumulator 1 and is pressure-relieved into the first return 30 via the shut discharge line 21 and the outlet control chamber 35. Because of this, the pressure in the compression chamber 9 of the pressure booster 3 increases in accordance with the boosting ratio of the pressure booster 3. This boosted pressure travels into the nozzle chamber 16 via the nozzle chamber inlet 17. The boosted pressure prevailing in the nozzle chamber 16 acts on the pressure shoulder of the injection valve member 14 and opens the valve member, thus unblocking the injection openings, which lead into the combustion chamber of the internal combustion engine, and initiating the injection phase. When the injection valve member 14 is completely open, the second throttle restriction 15 is closed so that no loss flow occurs during the injection phase.

To terminate the injection phase, the on/off valve 32 of the servo-valve 22 is closed, which causes the system pressure to build up in the control chamber 36 of the servo-valve 22. The system pressure 36 acts on the end surface 39 of the servo-valve piston 23 and moves the servo-valve piston 23 downward into its starting position, thus opening the second sealing seat 25 and once more closing the first sealing seat 24 that leads to the outlet control chamber 35 and the first return 30.

The opened second sealing seat 25 causes a pressure buildup in the differential pressure chamber 6 via the second hydraulic chamber 38 and the discharge line 21. In addition, the pressure prevailing in the pressure source 1 also builds up in the control chamber 12 for the injection valve member 14 via the working chamber 5, the first hydraulic chamber 37, the second hydraulic chamber 38, the discharge line 21, the differential pressure chamber 6, and the overflow line 10. As a result, the pressure drops in the compression chamber 9 and the nozzle chamber 16, which hydraulically communicate with each other via the nozzle chamber inlet 17. Because of the drop in the boosted pressure in the nozzle chamber 16 and the compression chamber 9, the injection valve member 14 closes, aided by the action of the spring 13, thus terminating the injection.

The first and second sealing seats 24 and 25 can be embodied in the form of combinations of flat, conical, ball, or slider seats (see depiction in FIG. 2).

The embodiment of a servo-valve 22 according to the present invention without guidance leakage can be used in all fuel injectors equipped with pressure boosters 3 that are controlled by means of a pressure change in the differential pressure chamber 6 (return chamber).

The foregoing relates to a preferred exemplary embodiment of the invention, it being understood that other variants and embodiments thereof are possible within the spirit and scope of the invention, the latter being defined by the appended claims.

The invention claimed is:

1. A fuel injector (18) for injecting fuel into a combustion chamber of an internal combustion engine, having a pressure booster (3) with a booster piston (4) which separates a working chamber (5) from a differential pressure chamber (6) that can be pressure-relieved, the working chamber (5) being continuously acted on with fuel by means of a pressure source (1,2) a servo-valve (22), wherein a pressure change in the differential pressure chamber (6) occurs via actuation of the servo-valve (22), the servo-valve (22) having a control chamber (36) which can be pressure-relieved by means of a valve (32), operation of valve (32) thus opening or closing a hydraulic connection (21, 38) of the differential pressure chamber (6) to a first return (30) on the low-pressure side, the improvement comprising a first sealing seat (24) sealing a return (30) on the low-pressure side off from a high-pressure region of the servo-valve (22) including the control chamber (36), a first hydraulic chamber (37), and a second hydraulic chamber (38), wherein the servo-valve (22) is actuated by means of the valve (32) that connects the control chamber (36) to a second return (31).

2. The fuel injector according to claim 1, wherein the control chamber (36) of the servo-valve (22) and the first hydraulic chamber (37) are connected to a pressure source (1) via the working chamber (5) of the pressure booster (3).

3. The fuel injector according to claim 1, wherein the second hydraulic chamber (38) communicates with the differential pressure chamber (6) via a discharge line (21) that can connect them to a first return (30) on the low-pressure side.

4. The fuel injector according to claim 3, wherein the servo-valve (22) includes a piston (23) which includes the first sealing seat (24) that opens or closes the first return (30) and a second sealing seat (25) that opens or closes the first hydraulic chamber (37).

5. The fuel injector according to claim 4, wherein the first sealing seat (24) is embodied in the form of a flat seat or a conical seat (40).

6. The fuel injector according to claim 4, wherein the first sealing seat (24) is embodied in the form of a conical seat or slider seal.

7. The fuel injector according to claim 4, wherein the second sealing seat (25) is embodied in the form of a conical seat (29, 33).

8. The fuel injector according to claim 4, wherein the second sealing seat (25) is embodied in the form of a slider seal (43, 44, 45).

9. The fuel injector according to claim 3, wherein the servo-valve piston (23) comprises a section encompassed by the second hydraulic chamber (38), which section has an annular surface (34) that is acted on by a residual pressure that moves the servo-valve piston (23) toward a second sealing seat (25) when the first sealing seat (24) is open.

10. The fuel injector according to claim 5, wherein the servo-valve piston (23), along with a first sealing seat (24) embodied with a flat seat design, is accommodated in a valve body (26; 27, 28) with a two-part design that compensates for an axial offset.

11. The fuel injector according to claim 4, wherein the servo-valve piston (23, 46) is embodied in a one-piece form.

* * * * *